United States Patent [19]

Reed et al.

[11] Patent Number: 4,785,164

[45] Date of Patent: Nov. 15, 1988

[54] SLIDE CALCULATOR FOR BACKGROUND LIGHTING

[76] Inventors: Muriel A. Reed; Roger G. Reed, both of 6704 Hoover Rd., Indianapolis, Ind. 46260

[21] Appl. No.: 73,166

[22] Filed: Jul. 13, 1987

[51] Int. Cl.[4] ..... G06C 3/00

[52] U.S. Cl. ..... 235/64.7; 235/70 R; 235/70 A; 235/85 R

[58] Field of Search ..... 235/64.7, 69, 70 R, 235/70 A, 85 R

[56] References Cited

U.S. PATENT DOCUMENTS

| | | | |
|---|---|---|---|
| 2,322,044 | 6/1943 | McFarlane et al. | 235/64.7 X |
| 2,532,892 | 12/1950 | Clark | 235/70 R X |
| 2,735,618 | 2/1956 | Venable | 235/64.7 |
| 3,933,305 | 1/1976 | Murphy | 235/70 A |
| 4,322,607 | 3/1982 | Diamondis | 235/64.7 |

*Primary Examiner*—B. R. Fuller

[57] ABSTRACT

There is disclosed herein a slide calculator for determination of flash-to-background distance for studio photography when using color filters over the flash. By use of the calculator, known factors, such as lens f-stop, film speed, flash guide number (GN), background density (darkness), desired degree of color (including shades of gray and white) saturation of said background and filter exposure factors can be used to determine the working distance of a background-flash with a color filter over the flash. An electronic flash meter is not required.

The calculator includes a front panel with a window-like aperture and a back panel. Two slide members are positioned and movable between the front and back panels. Indicia is provided on the front panel and is generally arranged adjacent the window like aperture. Indicia is also provided on the slide members and is arranged for exposure at the window.

In connection with distance to be determined, the indicia on the slides and the indicia adjacent the window are arranged in a predetermined manner and relationship so as to permit the distance to be calculated.

Photos or slides showing how various color filters will photograph in various shades provides a visual aid in choosing a color and shade and is used in conjunction with the slide calculator to determine the flash-to-background distance required to reproduce said color and shade.

5 Claims, 4 Drawing Sheets

SLIDE CALCULATOR FOR BACKGROUND LIGHTING

BACKGROUND OF THE INVENTION

This invention relates to slide calculators and images, in various shades, of various colors including neutral and white, and more specifically, to a calculator for determining the correct flash-to-background distance for creating color (includes shades of gray and white) backgrounds for photography using color filters (or no filter) over the flash lens and a neutral gray background and without the necessity of an electronic light meter. Some of the factors affecting the amount and quality of light striking the film in a camera are lens f-stop, exposure factors of filters over the camera lens, exposure factors of filters over the flash lens, size of the flashes, the distance of the main-light from the subject, the distance of the subject from the background, and the distance of the background-flash from the background.

The most common method used to produce a colored background (or neutral or white) in studio photography is to use a seamless roll of background paper of the desired color made specifically for this purpose. This requires the photographer to purchase a roll for every color that he may wish to use. Each roll costs about $35.00. The photographer sets up his lights and takes a meter reading and continues adjusting the lights and taking meter readings until he thinks the distance is correct. When using flash, an expensive electronic flash meter is required.

A different attempt is to put a color filter over the background light and project this color onto the background. The problems with this is that, until this invention, there was not a definite method to follow which would give predictable results. When using flash, it is impossible to visually inspect the amount of light on the background and adjust it until it is satisfactory. This invention provides a means for visually selecting a color and shade and determining exactly the distance required for the background-flash to reproduce that color and shade.

Prior to this invention, some of the unpredictable variables were (a) the background used may have had some color already inherent in it which would affect the color balance of the photograph.

(b) the density of the background may not have been known.

(c) without an electronic flash meter, the correct distance for the background-flash could only be guessed at.

(d) it was possible to visually select a color and shade and reproduce it even with the use of an electronic flash meter.

One or more of the following basic assumptions are made in almost every book or article on lighting color backgrounds:

(a) the photographer owns a balanced set of quartz lights;

(b) the photographer owns a balanced set of flashes with modeling lights that are proportional to the strobes;

(c) the photographer owns an electric flash meter if he is using flash;

(d) the photographer owns several rolls of seamless background paper of different colors;

(e) the studio is large enough to accommodate professional equipment;

(f) the photographer is willing to spend his time, the model's time and film required to find the background color and intensity he wants through trial and error.

None of the above are required when using this invention to produce color backgrounds with non-professional electronic flash.

Kodak publishes a book titled "Professional Portrait techniques" in which the instructions on lighting colored backgrounds consists of two paragraphs:

"Background Lighting: For the photograph to retain the same background color as you observe visually, the background must receive the same amount of illumination as the subject's face. For example, if the main light is 4 feet from the face, a light of equal intensity must be placed 4 feet from, and turned toward, the background. Position the subject 5 or 6 feet from the background in order to reduce the tendency for the spill from the main light to affect the background tone and color saturation. Do not rely on spill light to illuminate the background; it should be treated as a separate subject. Light it independently.

"Two other excellent reasons for placing the subject at least 5 or 6 feet from the background are to prevent the background color from reflecting appreciably onto the subject and to allow background detail to go out of focus."

Notice that Kodak expects the photographer to have a background light equal to his main light. Kodak does not attempt to explain how to use color filters with flash to create color backgrounds. A search of 16 other books on photographic lighting revealed no information on how to reproduce a specific color and shade desired using color filters on a flash. The books are Set Up Your Home Studio, (Kodak Limited), 1985

Gowland's Guide to Glamour Photography, Peter Gowland, 1972

The Secrets of Photographing Women, Peter Gowland, 1981

Photographic Lighting, Ralph Hattersley, 1979

Pro Techniques of People Photography, Gary Bernstein, 1984

Figure Photography, David Brooks, (Petersen's Photographic Library), 1974

Nude Photography, Peter Lacey, 1985

Portrait Photography How and Why, Mary Allen, 1977

Light and Lighting in Photography, Andreas Feininger, 1976

Exposure Control and Lighting, J. D. Cooper and J. C. Abbot, (Nikon Series), 1979

Special Effects Photography, Kathryn Livingston, 1985

How to Control & Use Photographic Lighting, David Brooks, 1980

How to Use Light Creativity, (HP Books), 1981

Electronic Flash, Jim Cornfield, (Petersen's Photographic Library), 1980

50 Portrait Lighting Techniques For Pictures That Sell, John Hart, 1983

The Art of Portraits and the Nude, (Kodak), 1983

Therefore, there is still a need for a calculator and companion images of shades of color, neutral and white, with matching filters, making it possible to calculate accurate flash working distances for a variety of colored, neutral or white backgrounds without the necessity of changing rolls of background paper each time a color change is needed, and without the need for the background-light and main-light to be equal or the need for an expensive electronic flash meter.

It is the object of this invention to make available to photographers, at a modest cost, an easy, accurate method of determining the necessary distance between the background-flash and the background which will reproduce a background color and shade, which is visually selected from images of a gray scale illuminated with color filters and no filter and identified as such—this taking into consideration many variables, some of which are:

(a) lens aperture (f-stop)
(b) film speed (ISO rating)
(c) density of filters (Filter Exposure Factor)
(d) relative power of flash (Guide Number or GN)
(e) the relative darkness (shade) of the Gray Background These and other objects of the invention will become apparent from the following description and appended claims.

SUMMARY OF THE INVENTION

There is provided by this invention images of a gray scale illuminated with colored light and identified as to which color filter was used to produce each respective image, and a three-piece slide calculator having a gray scale corresponding to said images for determining accurate working distances for any background-flash with any filter mounted thereon, thereby reproducing on a gray background the color associated with said filter and the particular shade selected from the image associated with said filter. The colors include all colors plus shades of gray and white.

The slide calculator includes an envelope-like structure having a front and back panel which are secured to one another. The front panel has at least one window-like aperture and includes indicia associated with said aperture. Two slide members are also provided which are positioned between the front and back panels and are movable therebetween. The slide members also include indicia thereon arranged to appear at the aperture and to cooperate with indicia on the front panel in order to permit the desired calculation.

For example, in determining the working distance for the background-flash, the front panel includes an aperture with a gray-scale arranged along the top edge, and blank space along the bottom edge upon which the User inscribes an index representing the combined effect of his background flash GN and gray background density.

Beginning at the top, the first movable slide includes a scale relating to film ISO arranged to cooperate and permit alignment with the gray-scale on the front panel. The opposite edge of said movable slide member includes indicia relating to lens f-stop.

The second movable slide includes indicia relating to total exposure factor (camera lens filter and background flash filter) arranged to cooperate and permit alignment with the lens f-stop indicia associated with the first movable slide member. The opposite edge of the second movable slide member includes indicia relating to the background-flash working-distance arranged to cooperate and permit alignment with a User inscribed index located on the bottom edge of the window.

By instructing the User of the calculator to inscribe an index on the bottom edge of the window-like aperture in a position relating to the combined effect of the density (darkness) of the Users own gray background and the relative power of his background-flash, the "Total Exposure Factor" on the top edge of the second slide member becomes the product of only two numbers; the Lens light modifying device exposure factor and the background-flash filter exposure factor.

A gray scale corresponding to the gray scale on the slide calculator is photographed while being illuminated with a different color filter for each image, then said image is identified with the name and exposure factor of the filter used. The color of the filters can be any color plus shades of gray and white. A group of such images and filters are provided with the slide calculator making it possible to actually see how a particular color filter at a particular shade (degree of color saturation) will appear in a photograph. The User simply chooses a color and shade from the images, sets the slide calculator on the same shade, completes the calculation, puts the corresponding color filter on the background-flash, places the background-flash at the calculated distance from the background and takes the photo.

DESCRIPTION OF THE PREFERRED EMBODIMENT

Definitions

Figure 1:
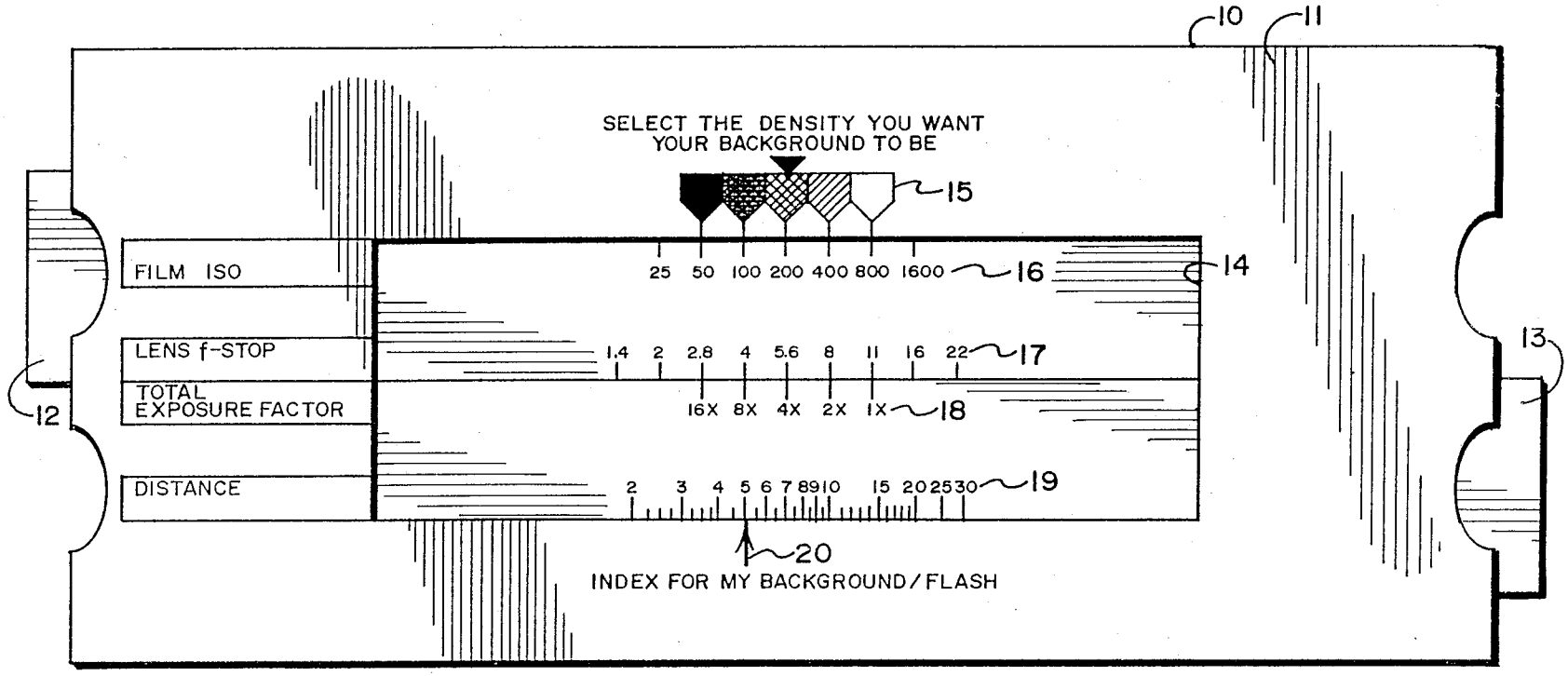
FIG. 1 is a plan view of the front panel with the slide members in position.

Color=Any color including shades of gray and white.

Cd=Color Density Coefficient (degree of color saturation).

$D_{bg\text{-}light}$=the Working-Distance between the Background-Light and the Background.

D=The first of two related distance measurements with d being the second measurement. It (D) is any distance between the Background-Light and a Gray Card which will give a meter reading that is a whole f-stop when reading light reflected from the Gray Card.

d=The second of two related distance measurements, with D being the first measurement. It (d) is the distance between the Background-Light and the Background which will give the same f-stop meter reading as when establishing D but when reading light reflecting from the Background.

$Dc=D^2/d^2$=Gray Background Density coefficient.

Density=Degree of color saturation. Darkness.

Ef=Exposure Factor of a light modifying device. Rating is based on a change in the magnitude of the amount of light required (not based on number of f-stops added). This rating is used to compensate for filters and other light modifying devices. Use 1X Exposure Factor for no filter.

$Ef_{bg}$=Exposure Factor of color filter on Background-Light.

$Ef_L$=Exposure Factor of light modifying device on camera lens.

$Ef_{total}=(Ef_1)(Ef_2)\ldots(Ef_n)$=Total Exposure Factor of n light modifying devices used in combination. Multiply the Exposure Factor of each of the light modifying devices times each other. Example: You want to use two light modifying devices for a particular photograph you want to make;

1.4X for lens extension tube.
1.4X for lens filter $$Ef_{total}=(1.4X)(1.4X)=2X$$

exposed normally: A photograph of a subject has the same percentage reflectance as the subject' when it is exposed normally.

f-difference=a rating of lens filters: Required number of f-stops to increase the lens aperture when using a filter.

$f_L$=Lens f-stop setting.

Fill-Light: a light which is positioned as near the Camera-Subject axis as possible so as to illuminate the entire Subject.

Gn or GN=Guide Number: a rating for a light expressed in ISO-feet or ISO-meters for the film ISO being used.

Gray Card: A standard 18% reflectance neutral gray photographic test card representing the average density of an average scene.

Main-Light: a light which, in combination with the Fill-Light, illuminates the Main-Side of the subject. Said Main-Light typically contributes a quantity of light equal to or greater than the Fill-Light. The Main-Light is also referred to as a Key-Light in some literature.

Shade=Degree of color saturation. Darkness.

General

The principals of the invention are:

1. By placing the Subject about the same distance from the Background as said subject is from the Main-Light or Fill-Light (whichever is greater), it is assured that the amount of light spilling on the Background from the Main-Light and Fill-Light combined will be only about ¼th as much as falls on said Subject according to the Inverse Square Law that governs the behavior of light. This is equivalent to 2 f-stops darker.

2. By making the Background neutral gray with a reflectance about one f-stop (or more) darker than Gray Card, it becomes the same color as the color filter placed over the Background-Light, with much less diluting influence by the Main-Light and Fill-Light than there would be if the Background were a lighter gray. A ligher gray would reflect more of the Main-Light and Fill-Light causing a washing-out of the Background color. The combined effect of the placement of the Main-Light and Fill-Light and the shade of the gray Background makes the combined Main-Light and Fill-Light reflecting from the Background about 3 f-stops darker than the confined Main-Light and Fill-Light reflecting from a Gray Card placed at said Subject, producing a Light-Ratio of 1 to 8 which causes even less diluting effect from the Main-Light and Fill-Light.

3. By determining how much the shade of the Gray Background is different from a Gray Card, and by expressing the difference as a density coefficient for said Background with the equation $$Dc=D^2/d^2$$

then plugging the coefficient into the equation $$D_{bg\text{-}light}=Gn/\{f_L(Ef_L Ef_{bg} DcCd)/^{(\frac{1}{2})}\}$$

its effect on the Background-Light Working Distance will be accounted for.

4. By placing a color filter over the Background-Light, and plugging the Filter Exposure Factor ($Ef_{bg}$) into the equation $$D_{bg\text{-}light}=Gn/\{f_L(Ef_L Ef_{bg} DcCd)^{(\frac{1}{2})}\}$$

its effect on the Background-Light Working Distance will be accounted for.

5. By using a gray scale with increments ranging from black to white where one of the segments represents the normal density of a Gray Card and is identified as such, and by letting the increments of gray represent the color density (Cd) desired for a color Background, an increment can be selected for said photograph and it's Cd value plugged into said equation $$D_{bg\text{-}light}=Gn/\{f_L(Ef_L Ef_{bg} DcCd)^{(\frac{1}{2})}\}$$

and its effect on the Background-Light Working Distance will be accounted for. As an aid to the eye in selecting a color and shade, color images of a gray scale corresponding to the gray scale on the calculator are included as an integral part of this invention (see "Color Images" below).

6. Optionally, light modifying devices can be attached to the camera Lens, and by plugging the Exposure Factor ($Ef_L$) into the equation $$D_{bg\text{-}light}=Gn/\{f_L(Ef_L Ef_{bg} DcCd)^{(\frac{1}{2})}\}$$

the effect on the Background-Light Working Distace will be accounted for.

Referring now to the drawings, there is shown a three-piece slide calculator 10 generally. The calculator includes a front panel 11 (see FIG. 1) and a back panel which are fastened together at the corners to form an envelope-like structure. Two slide members 12, and 13 (see FIG. 3) are provided and are positioned between the front panel and back panel for longitudinal movement therebetween, independent of each other (see FIG. 1).

The two slide members 12 and 13 include scales for cooperation with scales on the front panel 11.

Panel

Figure 2:
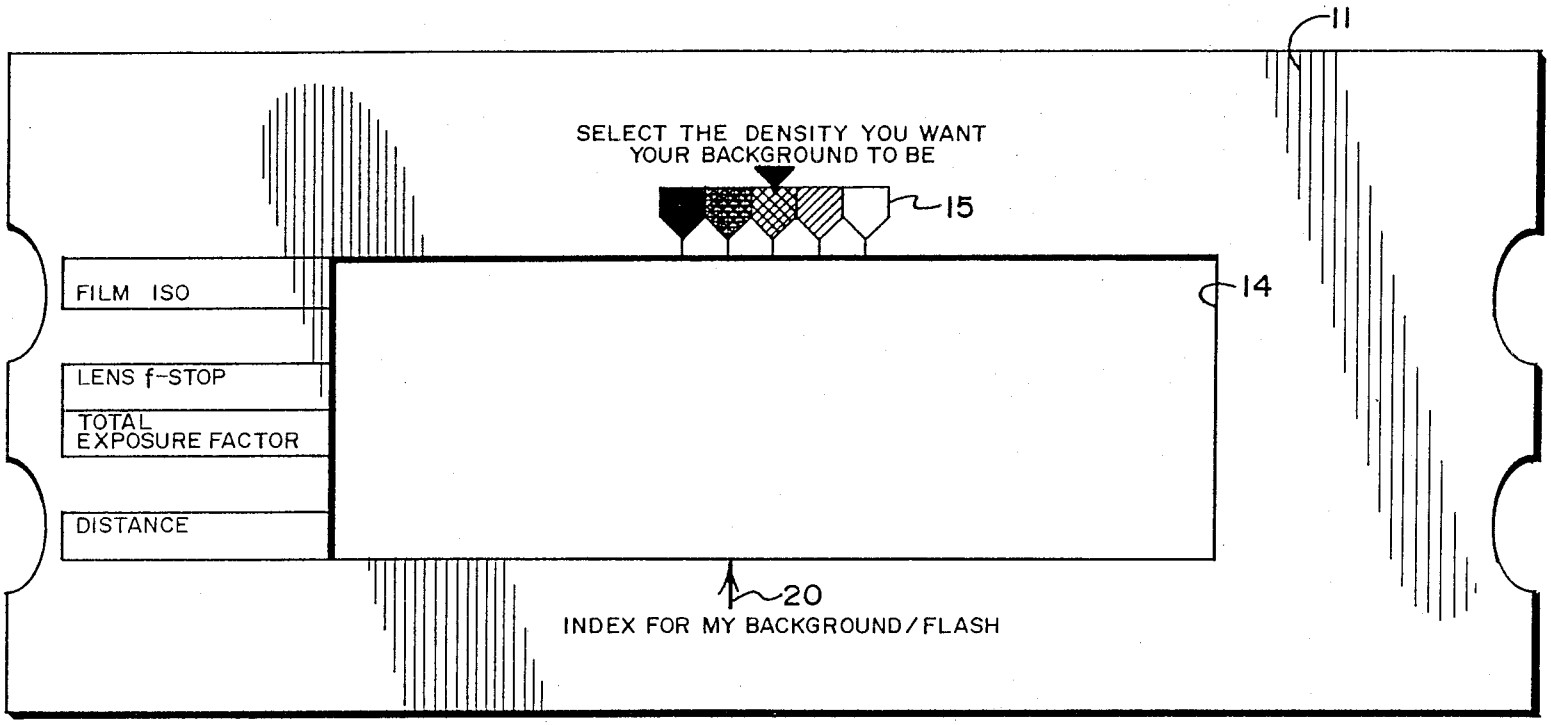
FIG. 2 is a plan view of the front panel.

Referring now to FIGS. 1 and 2, the front panel 11 includes an exposing window 14 which has a label "Film ISO" identifying scale 16 ranging from 25 to 1600, a label "Lens f-stop" identifying scale 17 ranging from f/1.4 to f/22, a label "Total Exposure Factor" identifying scale 18 ranging from 1X to 16X, and a label "Distance" identifying scale 19 ranging from 2 to 30.

A gray scale with shades of gray representing Color Background density (degree of color saturation) is located along the upper edge of said window.

The bottom edge of the window is labeled "Index for My Background/Flash" and has a blank space in which the User inscribes an index in a position relative to the combined effect of the GN of the User's background-light and the density coefficient of the User's Neutral-Gray-Background.

Slide Members

Figure 3:
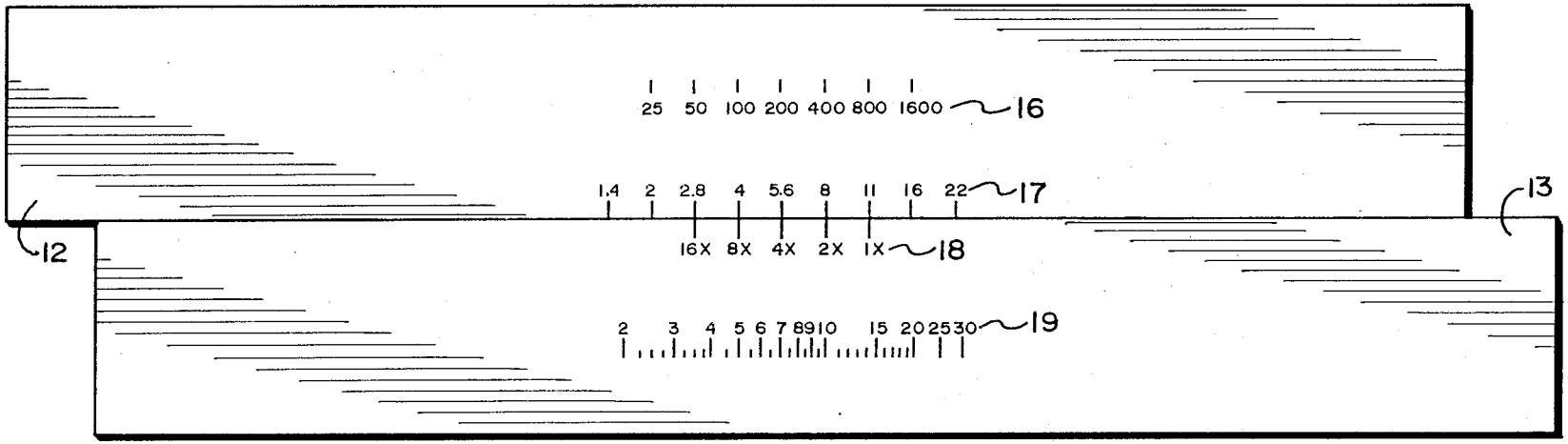
FIG. 3 is a plan view of the slide members.

Refering now to FIG. 1 and FIG. 3, the top slide member has a Film ISO scale 16 ranging from 25 to 1600 and is arranged to work in cooperation and permit alignment with the gray scale 15 positioned on panel 11. The bottom edge of the top slide member 12 has a lens f-stop scale 17 ranging from f/1.4 to f/22 and arranged to work in cooperation and permit alignment with the Total Exposure Factor scale 18 on the top of the bottom slide member 13.

The bottom slide member 13 has a Total Exposure Factor scale 18 positioned along the top edge ranging from 1X to 16X and arranged to work in cooperation and permit alignment with the f-stop scale 17 on the top slide member 12. The lower portion of the bottom slide member 13 has a Distance scale 19 ranging from 2 to 30 and arranged to work in cooperation and permit alignment with the Background/Flash Index 20 inscribed by the User of the slide calculator on the bottom edge of the window 14.

Set of Conditions and Example Calculations

A set of conditions is assumed for purposes of illustrating the example calculations performed. The conditions are:

Film ISO=200

Gn of Background-Light at Film ISO=60

$f_L$ Lens f-stop=f/5.6

$Ef_L$ of light modifying devices=1.2

$Ef_{bg}$ of Background-Light Filter=1.3

Dc Density Coefficient of Gray Background=1.5

Cd Color Density (shade) wanted=1.0

The following equation is solved to determine the Working Distance for the Background-Light:

$$D_{bg\text{-}light}=Gn/\{f_L(Ef_L Ef_{bg} DcCd)^{(\frac{1}{2})}\}$$

Referring to FIG. 1, the Working Distance for the Background-Light is determined by moving slide member 12 until the Film ISO of 200 is aligned with a Color Background Density Coefficient of 1.0 (density of a gray card) on scale 15 then moving slide member 13 until a Total Exposure Factor of about 1.5 (1.2×1.3) on scale 18 is aligned with f/5.6 on scale 17 then reading about 8 on the Distance scale 19 opposite the User inscribed Index 20.

Color Images

A photographic gray scale is photographed with a color filter over the light and with the exposure adjusted for the gray segment which reflects light approximately equal to a gray card and is identified as such. The image 21 thus produced is then marked with the name and Exposure Factor of the color filter that was used to produce the colored image 21 of the graduated gray scale.

The gray scale used corresponds to the Density scale 15 on the slide calculator, thus, this image 21 can be used to aid the User's eye in deciding which density (degree of color saturation) he prefers to set the slide calculator at when using this particular color filter.

Figure 4:
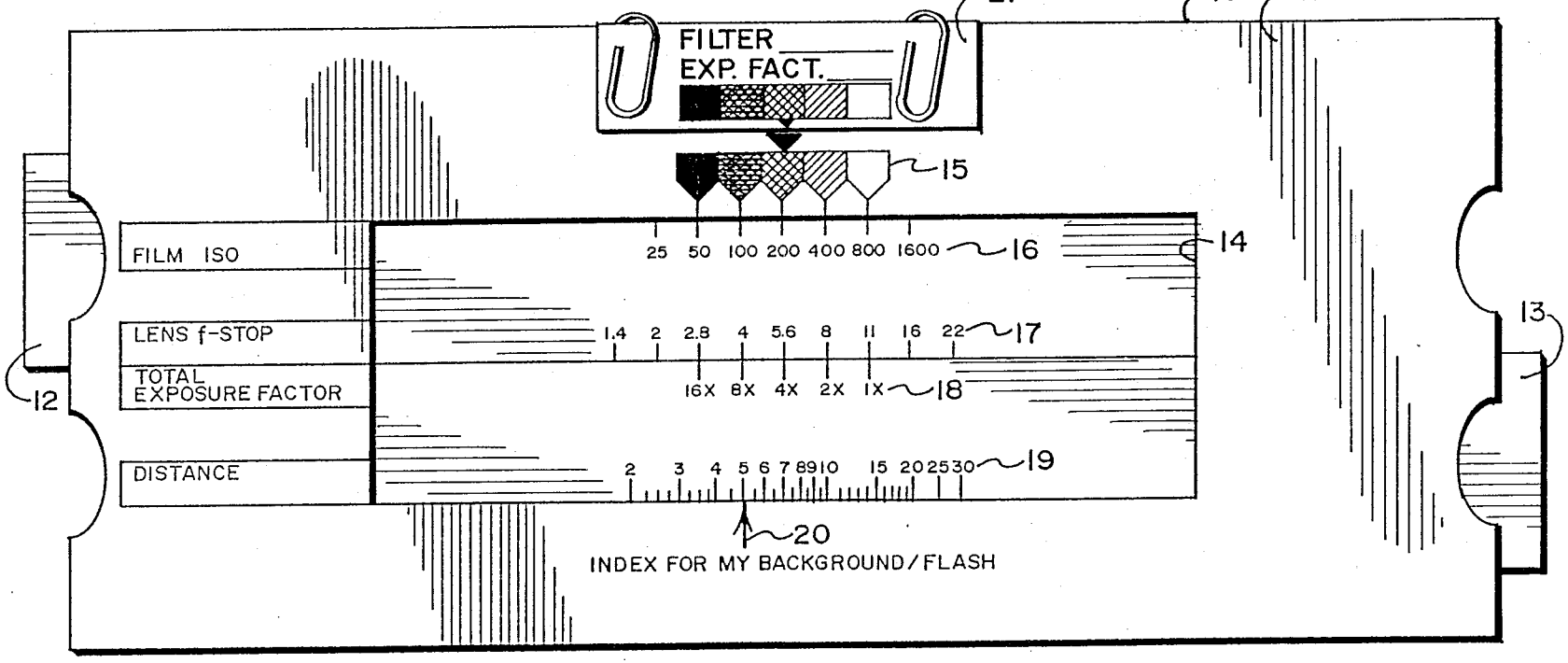
FIG. 4 is a plan view of the front panel with a colored image attached thereto.

In practice, a whole set of filters would be selected and photographed as described above and used in conjunction with the slide calculator (FIG. 4). An image 21 made without a filter would also be included for use in reproducing neutral gray backgrounds of various shades including white.

Other Comments

From the foregoing, it is seen that a simple three-piece calculator and images of a gray scale in various colors (including shades of gray and white) are provided for determining the working distance of a Background-Light with a color filter to provide correct exposure of photographic film for any Color Background selected. The above calculation is made possible in an inexpensive, quick and accurate manner.

It will also be appreciated that modifications can be made to the embodiments shown herein without departing from the spirit and scope of this invention. Such modifications include, but are not limited to, changing from a linear scale design to a circular scale design, changing the physical size, changing the upper and lower limits of one or more scales, changing the number of increments in the gray scale and using multiple flashes.

We claim:

1. A slide calculator for accurately duplicating a preselected color and color saturation (Cd) for a photographic image of a neutral-gray-background illuminated with background-light modified by one or more color filters, by calculating a correct working distance for said background-light (Dbg-light), comprising:

a panel member having a window-like aperture and first and second sliding members, said sliding members being cooperatively associated with each other and said panel member, and movable with respect to said panel member;

a first set of cooperating scales positioned on adjacent portions of said panel member and said first sliding member, a first scale of said first set being on said panel member and having spaced apart portions in f-stop increments being representative of color-background saturation (Cd), with an indicator adjacent a portion of said first scale which is representative of a gray card, a second scale of said first set being on said first sliding member and having spaced apart indicia representative of preselected film ISO;

a second set of cooperating scales positioned on adjacent portions of said first sliding member and said second sliding member, a first scale of said second set being on said first sliding member and having spaced apart indicia representative of preselected camera lens f-stop ($f_L$), a second scale of said second set being on said second sliding member and having spaced apart indicia representative of total exposure factor ($Ef_L Ef_{bg}$);

a third set of cooperating scales positioned on adjacent portions of said second sliding member and said panel member, a first scale of said third set being on said second sliding member and having spaced apart indicia representative of said background-light working distance ($D_{bg\text{-}light}$), an index of said third set being on said panel member and being representative of a neutral-gray-background saturation coefficient (Dc) and a preselected background-light guide number (Gn) combined, whereby;

said background-light working distance ($D_{bg\text{-}light}$) is provided by sliding said first sliding member until said preselected color saturation (Cd) for said color-background aligns with said preselected film ISO, then sliding said second sliding member until said preselected camera lens f-stop ($f_L$) aligns with said total exposure factor ($Ef_L Ef_{bg}$), then ascertaining said background-light working distance ($D_{bg\text{-}light}$) opposite said index.

2. A slide calculator as in claim 1, wherein the positioning of said scales relative to each other and the spacing of said indicia within said scales representing said preselected color saturation (Cd) of said background, film ISO, camera lens f-stop ($f_L$), total exposure factor ($Ef_L Ef_{bg}$), working distance of background-light ($D_{bg\text{-}light}$) and the location of said index are determined by the expression $$D_{bg\text{-}light} = Gn/\{f_L(Ef_L Ef_{bg} DcCd)^{(\frac{1}{2})}\}$$

where said total exposure factor ($Ef_L Ef_{bg}$) is representative of all light modifying devices on both said camera lens and said background-light respectively.

3. A slide calculator in claim 1 wherein said first scale of said first set is represented by any suitable media having a color image thereon that is a replica of a gray scale having spaced apart portions in f-stop increments illuminated by light modified by a color filter of a known color and known exposure factor where a portion of said gray scale, having a reflectance substantially equal to said gray-card, is exposed normally by said light and said color image media is labeled thereafter with said color and exposure factor of said color filter, said color image media being removably attached to said slide calculator.

4. A method for determining an index location on a slide calculator that is representative of the combined effect of both a specific background-light guide number (Gn) and a specific neutral-gray-background saturation coefficient (Dc) whereby said slide calculator can be used for accurately preselecting a color and a color saturation (Cd) for a photographic image of said neutral-gray-background illuminated with background-light modified by a color filter of said preselected color, by calculating a correct working distance for said background-light ($D_{bg\text{-}light}$);

said calculator comprising a panel member having a window-like aperture and first and second sliding members, said sliding members being cooperatively associated with each other and said panel member and movable with respect to said panel member;

a first set of cooperating scales positioned on adjacent portions of said panel member and said first sliding member, a first scale of said first set being on said panel member and being representative of color-background saturation (Cd), a second scale of said first set being on said first sliding member and being representative of film ISO;

a second set of cooperating scales positioned on adjacent portions of said first sliding member and a second sliding member, said first scale of said second set being on said first sliding member and being representative of camera lens f-stop ($f_L$), a second scale of said second set being on said second sliding member and being representative of total exposure factor ($Ef_L Ef_{bg}$);

a third set of cooperating scales positioned on adjacent portions of said second sliding member and said panel member, a first scale of said third set being on said second sliding member and being representative of background-light working distance ($D_{bg\text{-}light}$), an index of said third set being on said panel member and being representative of said neutral-gray-background saturation coefficient (Dc) and background-light guide member (Gn) combined;

said method comprising the following steps:

(a) determining the guide number (Gn) of said background-light;

(b) determining the saturation coefficient (Dc) of said neutral-gray-background, under white light, by solving the equation $$Dc = D^2/d^2;$$

where d is a distance required between said background-light and said neutral-gray-background to cause an amount of light reflecting from said neutral-gray-background to be substantially equal to an amount of light reflecting from a gray-card when said background-light is a distance D from said gray-card;

(c) choosing a camera lens f-stop ($f_L$);

(d) detetermining said background-light working distance ($D_{bg\text{-}light}$) by solving the equation $$D_{bg\text{-}light} = Gn/\{f_L(Dc)^{(\frac{1}{2})}\};$$

(f) moving said first sliding member of said calculator until said ISO aligns with the portion of the gray-scale identified as having a saturation substantially equal to said gray-card;

(g) moving said second sliding member until 1X exposure factor aligns with said f-stop;

(h) inscribing an index in alignment with the determined background-light working distance ($D_{bg\text{-}light}$) on the panel member at a bottom edge of said window;

(i) labeling said index as being representative of the combination of said neutral-gray-background and said background-light.

5. A method for accurately duplicating a preselected color and color saturation (Cd) for a photographic image of a neutral-gray-background illuminated with background-light modified by one or more color filters, by calculating a correct working distance for said background-light (Dbg-light) with a slide calculator for background lighting comprising:

a panel member having a window-like aperture and first and second sliding members, said sliding members being cooperatively associated with each other and said panel member, and movable with respect to said panel member;

a first set of cooperating scales positioned on adjacent portions of said panel member and said first sliding member, a first scale of said first set being on said panel member and having spaced apart portions in f-stop increments being representative of color-background saturation (Cd), with an indicator adjacent a portion of said first scale which is representative of a gray card, a second scale of said first set being on said first sliding member and having spaced apart indicia representative of preselected film ISO;

a second set of cooperating scales positioned on adjacent portions of said first sliding member and said second sliding member, a first scale of said second set being on said first sliding member and having spaced apart indicia representative of preselected camera lens f-stop ($f_L$), a second scale of said second set being on said second sliding member and having spaced apart indicia representative of total exposure factor ($Ef_L Ef_{bg}$);

a third set of cooperating scales positioned on adjacent portions of said second sliding member and said panel member, a first scale of said third set being on said second sliding member and having spaced apart indicia representative of background-light working distance ($D_{bg\text{-}light}$), an index of said third set being on said panel member and being representative of a neutral-gray-background saturation coefficient (Dc) and a preselected background-light guide number (Gn) combined;

said method comprising the steps of;

(a) using said neutral-gray-background saturation coefficient (Dc) approximately one f-stop darker than said gray card;

(b) making a photographic image, on a suitable photographic media, of said gray scale representing a scale of f-stops illuminated by said background-light modified by one or more color filters, by adjusting said background-light and camera lens aperture so that the portion of said gray scale adjacent said indicator is exposed normally by said background-light and labeling said image by any suitable means, with said color and exposure factor of said color filters;

(c) selecting and making note of which f-stop portion of said image of said gray scale is to be duplicated in said image of said neutral-gray-background;

(d) determining and making note of said total exposure factor ($Ef_L Ef_{bg}$) which is representative of a combination of all light modifying devices on a camera lens plus all filters on said background-light;

(e) limiting a sum of a main-light and a fill-light spilling on said neutral-gray-background to no more than about ¼th an amount of light required for normal exposure of a subject by placing said subject a distance from said neutral-gray-background that is substantially at least as great as a distance between said main-light and said subject and substantially at least as great as a distance between said fill-light and said subject;

(f) Selecting a power for said background-light which is proportional to an area of said background desired to be illuminated with the selected color saturation (Cd);

(g) determining said working distance ($D_{bg\text{-}light}$) from said background-light to said neutral-gray-background by solving the equation $$D_{bg\text{-}light} = Gn/\{f_L(Ef_L Ef_{bg} DcCd)^{(\frac{1}{2})}\}$$

by sliding said first sliding member until said preselected film ISO aligns with said portion of said first scale of said first set of scales which corresponds to said f-stop portion of said image of said gray scale that matches said color saturation (Cd) to be duplicated, then sliding said second sliding member until said preselected camera lens f-stop ($f_L$) aligns with said total exposure factor ($Ef_L Ef_{bg}$), then finally reading out said background-light working distance ($D_{bg\text{-}light}$) on said second sliding member opposite said index on said panel member.

* * * * *